US012134002B2

(12) United States Patent
Huang

(10) Patent No.: US 12,134,002 B2
(45) **Date of Patent: *Nov. 5, 2024**

(54) WEIGHT BAR STOPPER

(71) Applicant: POWERTEC, INC., Paramount, CA (US)

(72) Inventor: Sheng Hsiung Tony Huang, Paramount, CA (US)

(73) Assignee: Powertec, Inc., Paramount, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/129,858

(22) Filed: Apr. 1, 2023

(65) Prior Publication Data

US 2023/0233897 A1 Jul. 27, 2023

Related U.S. Application Data

(63) Continuation of application No. 17/343,666, filed on Jun. 9, 2021, now Pat. No. 11,642,562, which is a continuation of application No. 16/512,327, filed on Jul. 15, 2019, now Pat. No. 11,135,468.

(51) Int. Cl.
*A63B 21/072* (2006.01)
*A63B 21/075* (2006.01)

(52) U.S. Cl.
CPC ..... *A63B 21/0728* (2013.01); *A63B 21/0726* (2013.01); *A63B 21/075* (2013.01)

(58) Field of Classification Search
CPC . A63B 21/06; A63B 21/0601; A63B 21/0615; A63B 21/0616; A63B 21/062; A63B 21/072; A63B 21/0722; A63B 21/0724; A63B 21/0726; A63B 21/4023; A63B 21/40
See application file for complete search history.

(56) References Cited

U.S. PATENT DOCUMENTS

| | | | | |
|---|---|---|---|---|
| 4,638,994 | A * | 1/1987 | Gogarty | A63B 21/0728 411/417 |
| 7,578,772 | B2 * | 8/2009 | Lippitt | A63B 21/075 482/106 |
| 7,775,948 | B2 * | 8/2010 | Chen | A63B 21/0728 482/106 |
| 8,932,188 | B2 * | 1/2015 | Svenberg | A63B 21/0728 482/106 |
| 9,138,610 | B2 * | 9/2015 | Lovegrove | A63B 21/0004 |
| 2007/0161474 | A1 * | 7/2007 | Lippitt | A63B 21/0728 482/106 |

* cited by examiner

*Primary Examiner* — Zachary T Moore
(74) *Attorney, Agent, or Firm* — David & Raymond Patent Firm; Raymond Y Chan

(57) ABSTRACT

A exercise equipment includes a weight bar, a plurality of weight plates slidably coupled at two ends portions of the weight bar from two free ends thereof respectively, and a weight bar stopper built-in at each of the end portions of the weight bar to increase a peripheral size of the weight bar at the end portion thereof to block the weight plate being slid out of the free end of the weight bar. When the weight bar stopper is actuated to adjust the peripheral size of the weight bar back to its original size, the weight plate is allowed to be slid in and out the end portion of the weight bar.

6 Claims, 5 Drawing Sheets

WEIGHT BAR STOPPER

CROSS REFERENCE OF RELATED APPLICATION

This application is a Continuation application that claims the benefit of priority under 35 U.S.C. § 120 to a non-provisional application, application Ser. No. 17/343,666, filed Jun. 9, 2021, which is a Continuation application that claims the benefit of priority under 35 U.S.C. § 120 to a non-provisional application, application Ser. No. 16/512,327, filed Jul. 15, 2019, which are incorporated herewith by reference in their entirety.

BACKGROUND OF THE PRESENT INVENTION

Field of Invention

The present invention relates to an exercise equipment, and more particularly to a weight bar stopper, which can rapidly and securely lock up weight plates at two end portions of the weight bar.

Description of Related Arts

A dumbbell is one of popular exercise equipments used in weight training, weightlifting, and bodybuilding. The conventional dumbbell generally comprises a weight bar and a plurality of weight plates selectively coupled at two end portions of the weight bar respectively to selectively adjust a total weight of the dumbbell. The dumbbell further comprises two collars detachably coupled at the end portions of the weight bar to prevent the weight plates being slid out of the weight bar. However, the conventional dumbbell has several drawbacks.

Each of the collars comprises a ring-shaped clamping member detachably clamped on the weight bar after the weight plate is slid thereat. The grip strength of the collar will be weaker due to the unwanted sliding movement of the weight plates along the weight bar and due to the usage time. The weight plates cannot be stably retained in position along the weight bar once the grip strength of the collar is reduced. Furthermore, the dumbbell cannot be used when the collar is broken or lost. It is worth mentioning that the collars can be slid along the weight bar at any position to block the outward sliding movement of the weight plates. In other words, the lifter or a trainer will clamp the collars at the weight bar by experience in order to keep the weight plates at the weight bar in an even manner. However, a slightly off relative position between the collars at the weight bar will cause the uneven force for the lifter.

SUMMARY OF THE PRESENT INVENTION

The invention is advantageous in that it provides a weight bar stopper, which can rapidly and securely lock up weight plates at two end portions of the weight bar.

Another advantage of the invention is to provide a weight bar stopper, wherein a plurality of stopper members are spacedly provided along each end portion of the weigh bar to block the weight plate being slid at the end portion of the weight bar.

Another advantage of the invention is to provide a weight bar stopper, which is built-in at each of the end portions of the weight bar to prevent any accidently loss of external component to the weight bar.

Another advantage of the invention is to provide a weight bar stopper, wherein each of the stopper members is actuated independently to selectively couple one or more weight plates at the weight bar and to selectively retain different positions of the weight plates along the end portion of the weight bar.

Another advantage of the invention is to provide a weight bar stopper, which can incorporate with different weight bars having different cross sections at the end portions thereof to secure the weight plates at the end portion of the weight bar.

Another advantage of the invention is to provide a weight bar stopper, wherein the weight bar stopper is built-in with the weight bar to form a weight bar assembly to incorporate with any existing weight plate, such that the user is able to use the existing weight plates to detachably couple at the weight bar assembly.

Another advantage of the invention is to provide a weight bar stopper, which can be an add-on component to integrally attach to the end portion of the existing weight bar in order to secure the weight plate thereat.

Another advantage of the invention is to provide a weight bar stopper, which does not require altering the original structural design of the exercise equipment, so as to minimize the manufacturing cost of the weight bar stopper that incorporates the weight plates.

Another advantage of the invention is to provide a weight bar stopper, wherein no expensive or complicated structure is required to employ the present invention in order to achieve the above mentioned objectives. Therefore, the present invention successfully provides an economic and efficient solution to provide a securing means for rapidly and securely lock up weight plates at two end portions of the weight bar.

Additional advantages and features of the invention will become apparent from the description which follows, and may be realized by means of the instrumentalities and combinations particular point out in the appended claims.

According to the present invention, the foregoing and other objects and advantages are attained by an exercise equipment, comprising:

a weight bar;

a plurality of weight plates slidably coupled at two end portions of the weight bar from two free ends thereof respectively; and a weight bar stopper built-in at each of the end portions of the weight bar to increase a peripheral size of the weight bar at the end portion thereof to block the weight plate being slid out of the free end of the weight bar, wherein when the weight bar stopper is actuated to adjust the peripheral size of the weight bar back to its original size, the weight plate is allowed to be slid in and out the end portion of the weight bar.

In accordance with another aspect of the invention, the present invention comprises a weight bar assembly for detachably coupling a plurality of weight plates, wherein the weight bar assembly comprises:

a weight bar for the weight plates slidably coupling at two end portions of the weight bar from two free ends thereof respectively; and a weight bar stopper built-in at each of the end portions of the weight bar to increase a peripheral size of the weight bar at the end portion thereof for blocking the weight plate being slid out of the free end of the weight bar, wherein the weight bar stopper is actuated to adjust the peripheral size of the weight bar back to its original size for allowing the weight plate to be slid in and out the end portion of the weight bar.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
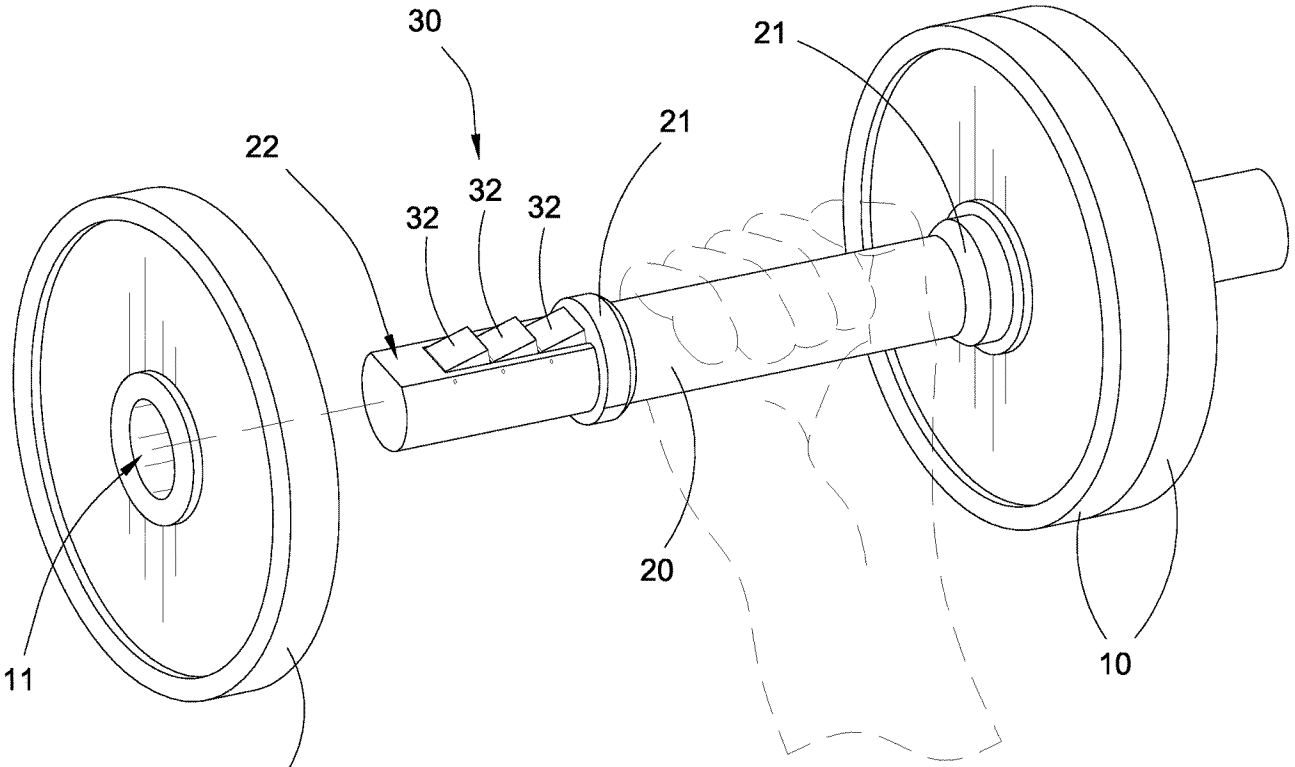
FIG. 1 is a perspective view of a exercise equipment according to a first preferred embodiment of the present invention.

Referring to FIG. 1 of the drawings, a exercise equipment according to a first embodiment of the present invention is illustrated, wherein the exercise equipment comprises a weight bar assembly and a plurality of weight plates 10. The weight bar assembly comprises a weight bar 20 and a weight bar stopper 30, wherein the weight plates 10 are slidably coupled at two end portions of the weight bar 20 from two free ends thereof respectively.

In one embodiment, the weight bar stopper 30 is built-in at each of the end portions of the weight bar 20 to increase a peripheral size of the weight bar 20 at the end portion thereof to block the weight plate 10 being slid out of the free end of the weight bar 20. When the weight bar stopper 30 is actuated to adjust the peripheral size of the weight bar 20 back to its original size, the weight plate 10 is allowed to be slid in and out the end portion of the weight bar 10. As a result, the overall weight of the exercise equipment of the present invention can be selectively adjusted.

According to the preferred embodiment, each of the weight plates 10 has a center through slot 11, wherein the end portion of the weight bar 20 is able to slidably penetrate through the center through slot 11 of the weight plate 10 to couple the weight plate 10 at the end portion of the weight bar 20. Accordingly, when the weight plates 10 are coupled at two end portions of the weight bar 20, the exercise equipment forms a dumbbell that the user is able to control the exercise equipment by one hand. The weight plate 10 is loaded at the weight bar 20 by sliding the weight plate 10 from the free end of the weight bar 20 along the end portion thereof at a loading direction. The weight plate 10 is unloaded at the weight bar 20 by sliding the weight plate 10 out of the free end of the weight bar 20 along the end portion thereof at an unloading direction which is opposite to the loading direction.

The weight bar stopper 30 is actuated between an accessing position to replace the weight plates 10 from the weight bar 20 and stopping position to lock the weight plates 10 at the weight bar 20. Particularly, at the accessing position, the weight bar stopper 30 is aligned along an axis of the weight bar 20 to allow the weight plate 10 being slid at the end portion thereof, such that the weight plate 10 can be detached from the weight bar 20 and a new weight plate 10 can be coupled thereto. At the stopping position, the weight bar stopper 30 is radially protruded out of the weight bar 20 to block the weight plate 10 being slid out of the free end of the weight bar 20, so as to lock up the weight plate 10 at each of the end portions of the weight bar 20. It is worth mentioning that two or more weight plates 10 can be coupled at one free end portion of the weight bar 20 and locked by the weight bar stopper 30.

Figure 2:
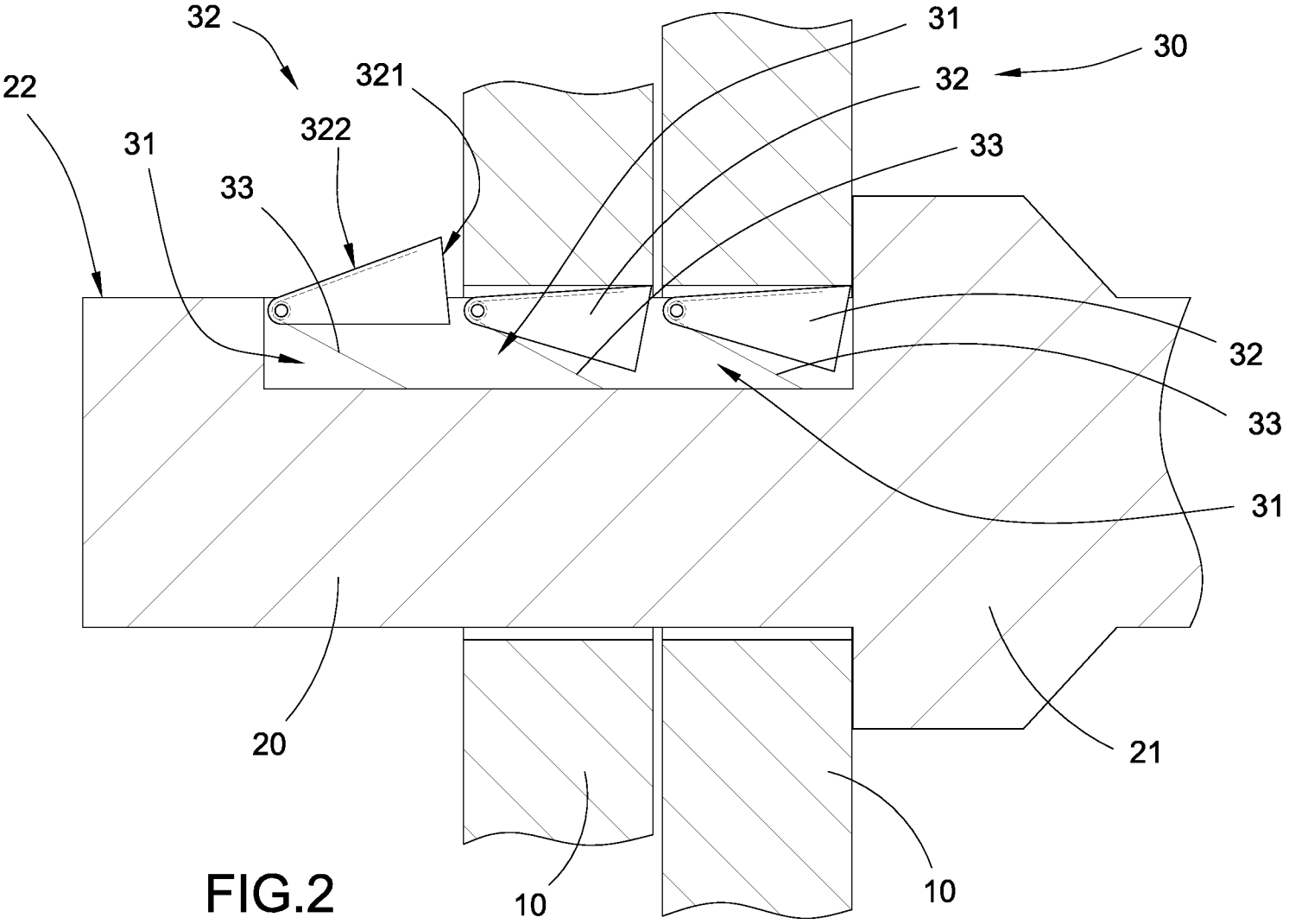
FIG. 2 is a sectional view of the exercise equipment according to the above first embodiment of the present invention.

As shown in FIGS. 1 and 2, the weight bar 20 comprises two stopping rims 21 spacedly and outwardly therefrom to define the weight bar 20 into two outer portions and a mid-portion. The outer portions of the weight bar 20 are the end portions thereof and the mid-portion of the weight bar 20 serves as hand gripping portion thereof. In other words, the end portion of the weight bar 20 is defined between the free end thereof and the stopping rim 21. The diameter of each of the stopping rims 21 is larger than a diameter center through slot 11 of the weight plate 10, such that when the weight plate 10 is slid along the end portion of the weight bar 20, the weight plate 10 is blocked by the respective stopping rim 21 to prevent the weight plate 10 being slid at the hand gripping portion of the weight bar 20.

In one embodiment, each end portion of the weight bar 20 has a non-circular cross section defining a flat outer surface 22 that the weight bar stopper 30 is formed at the flat outer surface 22 of the weight bar 20, wherein the flat outer surface 22 is extended from the respective stopping rim 21.

The weight bar stopper 30 comprises a plurality of receiving cavities 31 spacedly indented on the flat outer surface 22 of the weight bar 20 and a plurality of stopper members 32 movably received within the receiving cavities 31 respectively. At the accessing position, the stopper members 32 are received in the receiving cavities 31 respectively to align along the axis of the weight bar 20 so as to allow the weight plate 10 being slid in and out the end portion of the weight bar 20. At the stopping position, the stopper members 32 are protruded out of the receiving cavities 31 to block the weight plate 10 being slid at the end portion of the weight bar 20.

As shown in FIG. 2, the receiving cavities 31 are communicated with each other to form a receiving channel indented on the flat outer surface 22 of the weight bar 20, wherein the stopper members 32 are spacedly supported along the receiving channel.

Each of the stopper members 32 is pivotally coupled at the weight bar 20 within the respective receiving cavity 31, wherein each of the stopper members 32 is pivotally moved in-and-out the respective receiving cavity 31. Each of the stopper members 32 has a blocking surface 321 arranged in such a manner that when the stopper member 32 is moved in the receiving cavity 31 to hide the blocking surface 321 therewithin, the weight plate 10 is adapted to slidably couple at the end portion of the weight bar 20. When the stopper member 32 is moved out of the receiving cavity 31 to protrude the blocking surface 321 thereof, the weight plate 10 is adapted to lock at the end portion of the weight bar 20.

According to the preferred embodiment, each of the stopper members 32 has a guiding surface 322 opposed to the blocking surface 321 to guide the sliding movement of the weight plate 10 along the end portion of the weight bar 20. Accordingly, when the stopper member 32 is received in the receiving cavity 31, the guiding surface 322 of the stopper member 32 is aligned with the flat outer surface 22 of the weight bar 20 to hide the blocking surface 321 of the stopper member 32. When the stopper member 32 is pivotally moved out of the receiving cavity 31, the blocking surface 321 of the stopper member 32 is protruded from the flat outer surface 22 of the weigh bar 20 to block the weight plate 10 being slid at the end portion of the weight bar 20.

In one embodiment, each of the stopper members 32 has a triangular shape defining the blocking surface 321 of the stopper member 32 being perpendicular to the flat outer surface 22 of the weight bar 20 and the guiding surface 321 of the stopper member 32 being inclined to the flat outer surface 22 of the weight bar 20 when the stopper member 32 is protruded out of the receiving cavity 31. In other words, the guiding surface 321 of the stopper member 32 is downwardly inclined toward the free end of the weight bar 20.

The weight bar stopper 30 further comprises a plurality of resilient members 33 supported in the receiving cavities 31 to bias against the stopper members 32 respectively so as to push the blocking surface 321 of the stopper member 32 protruded from the flat outer surface 22 of the weigh bar 20. As shown in FIG. 2, each of the resilient members 33 is a coil spring having a bottom end coupled at the bottom wall of the receiving cavity 31 and an upper end coupled at the stopper member 32, wherein a mid-portion of the resilient member 32 is coupled at a pivot point of the stopper member 32, such that the resilient member 32 is arranged to apply a resilient force for the stopper member 32 to pivotally push the stopper member 32 out of the receiving cavity 31 so as to retain the stopper member 32 at the stopping position.

Accordingly, each of the stopper members 32 is actuated independently. Two or more stopper members 32 are provided at the flat outer surface 22 along each end portion of the weight bar 20. One of the stopper members 32 can be actuated to move from its stopping position to the accessing position, while another stopper member 32 is remained at the stopping position. In other words, the stopper members 32 can retained at the different positions. In one embodiment, there are three stopper members 32 provided at each end portion of the weight bar 20, wherein the first stopper member 32 is located close to the free end of the weight bar 20, the third stopper member 32 is located close to the stopping rim 21 of the weight bar 20, and the second stopper member 32 is located between the first and third stopper members 32. When the weight plate 10 is slid to the end portion of the weight bar 20 at the loading direction, the inner circumferential wall of the center through slot 11 of the weight plate 10 is slid at the guiding surface 322 of the first stopper member 32 to pivotally push the first stopper member 32 from the blocking position to the accessing position. Once the weight plate 10 passes the first stopper member 32, the first stopper member 32 is pivotally moved back to the blocking position from the accessing position via the resilient member 33. As a result, the weight plate 10 is blocked by the blocking surface 321 of the first stopper member 32 to prevent the weight plate 10 being slid out of the free end of the weight bar 20 at the unloading direction. Accordingly, the weight plate 10 can further slide to pass the second and third stopper members 32 until the weight plate 10 is blocked by the stopping rim 21 of the weight bar 20. The location of the weight plate 10 can be selectively adjusted via the stopper members 32. Furthermore, two or more weight plates 10 can be locked at one end portion of the weight bar 20. In order to detach the weight plate 10 from the weight bar 20, the user is able to press the stopper member 32 to pivotally move the stopper member 32 in the receiving cavity 31. Once the stopper member 32 is received in the receiving cavity 31 to hide the blocking surface 321 of the stopper member 32, the weight plate 10 can be slid out of the free end of the weight bar 20 at the unloading direction.

Figure 3:
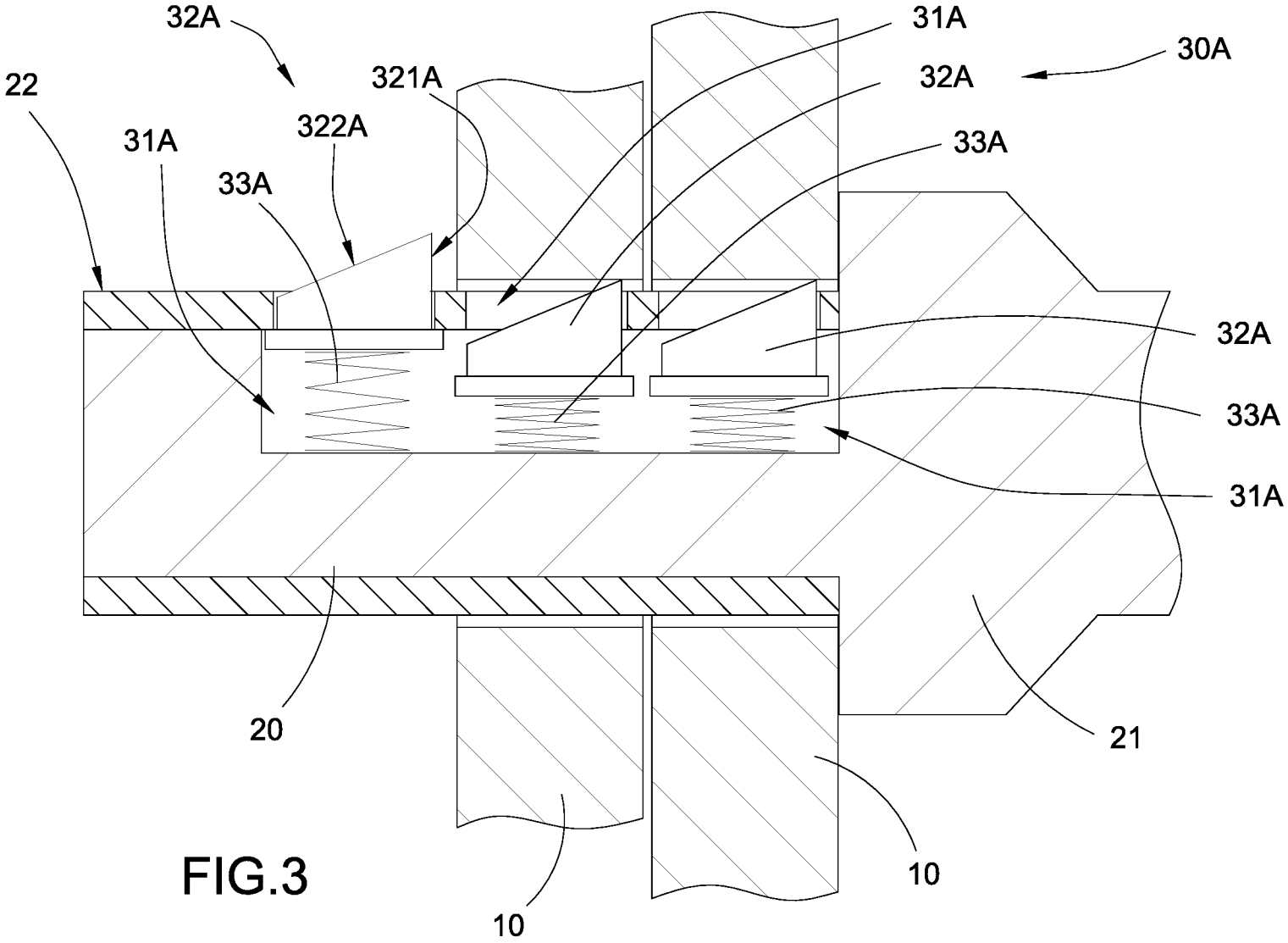
FIG. 3 illustrates an alternative mode the weight bar stopper of the exercise equipment according to the above first embodiment of the present invention.

FIG. 3 illustrates an alternative mode of the weight bar stopper 30A which comprises a plurality of receiving cavities 31A spacedly indented on the flat outer surface 22 of the weight bar 20 and a plurality of stopper members 32A movably received within the receiving cavities 31A respectively. Each of the stopper members 32A is moved between the accessing position and the stopping position. At the accessing position, the stopper members 32A are received in the receiving cavities 31A respectively to align along the axis of the weight bar 20 so as to allow the weight plate 10 being slid in and out the end portion of the weight bar 20. At the stopping position, the stopper members 32A are protruded out of the receiving cavities 31A to block the weight plate 10 being slid at the end portion of the weight bar 20.

In this alternative mode, each of stopper members 32A is slidably coupled at the weight bar 20. Particularly, the stopper member 32A is extended perpendicular to the flat outer surface 22 of the weight bar 20. Likewise, each of the stopper members 32A has a triangular shape defining a guiding surface 322A and a blocking surface 321A. When the stopper member 32A is received in the receiving cavity 31A, the guiding surface 322A of the stopper member 32A is aligned with the flat outer surface 22 of the weigh bar 20 to hide the blocking surface 321A of the stopper member 32A. When the stopper member 32A is slid out of the receiving cavity 31A, the blocking surface 321A of the stopper member 32A is protruded from the flat outer surface 22 of the weigh bar 20 to block the weight plate 10 being slid at the end portion of the weight bar 20.

The weight bar stopper 30A further comprises a plurality of resilient members 33A supported in the receiving cavities 31A to bias against the stopper members 32A respectively so as to push the blocking surface 321A of the stopper member 32A protruded from the flat outer surface 22 of the weigh bar 20. As shown in FIG. 3, each of the resilient members 33A is a compression spring having a bottom end coupled at the bottom wall of the receiving cavity 31A and an upper end coupled at the stopper member 32A to retain the stopper member 32A at the blocking position, such that the resilient member 32A is arranged to apply a resilient force for the stopper member 32A to upwardly push the stopper member 32A out of the receiving cavity 31A so as to retain the stopper member 32A at the stopping position. Accordingly, each of the stopper members 32A is actuated independently to downwardly push the stopper member 32A from the blocking position to the accessing position.

Figure 4:
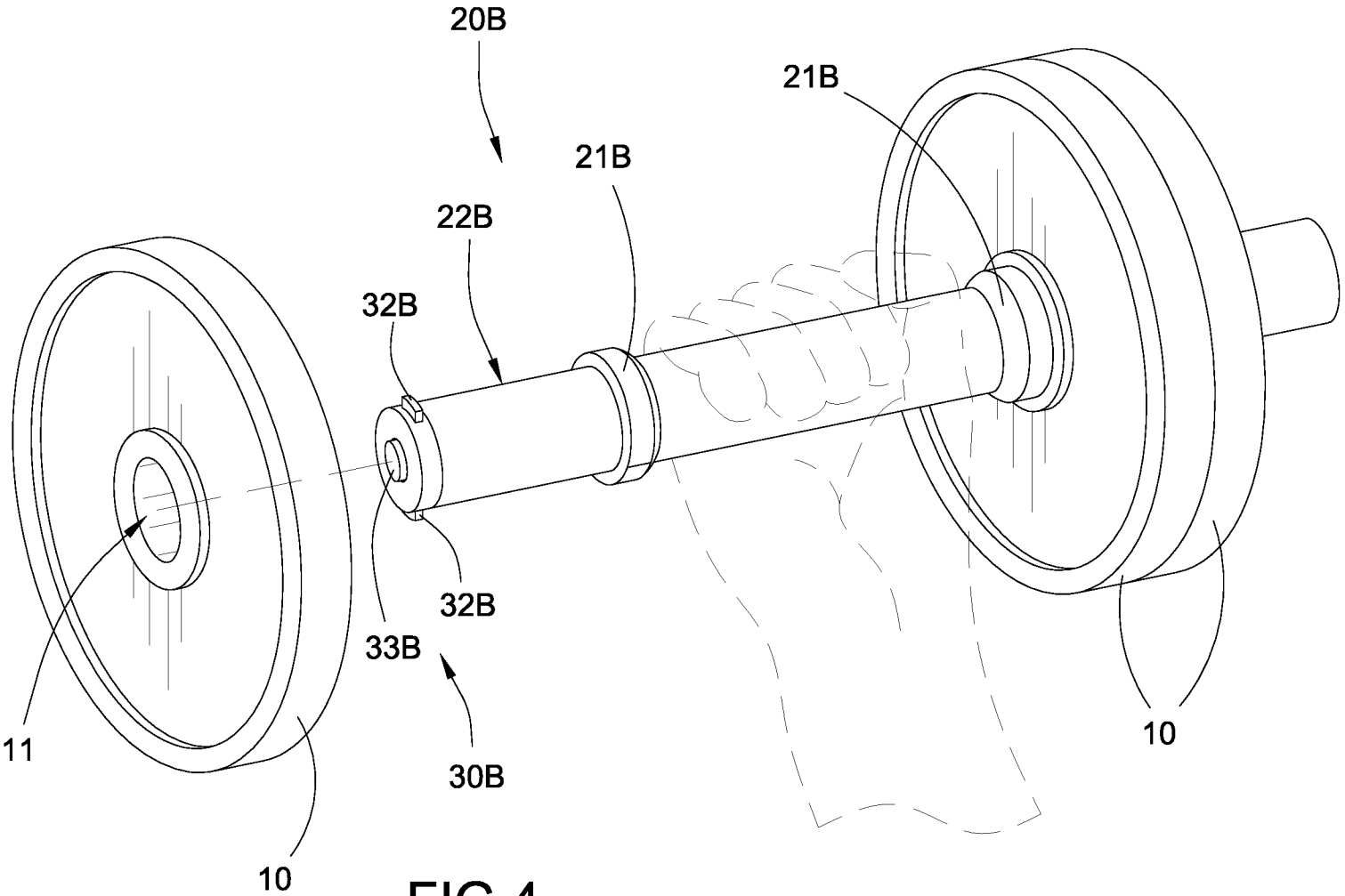
FIG. 4 is a perspective view of a exercise equipment according to a second preferred embodiment of the present invention.
Figure 5:
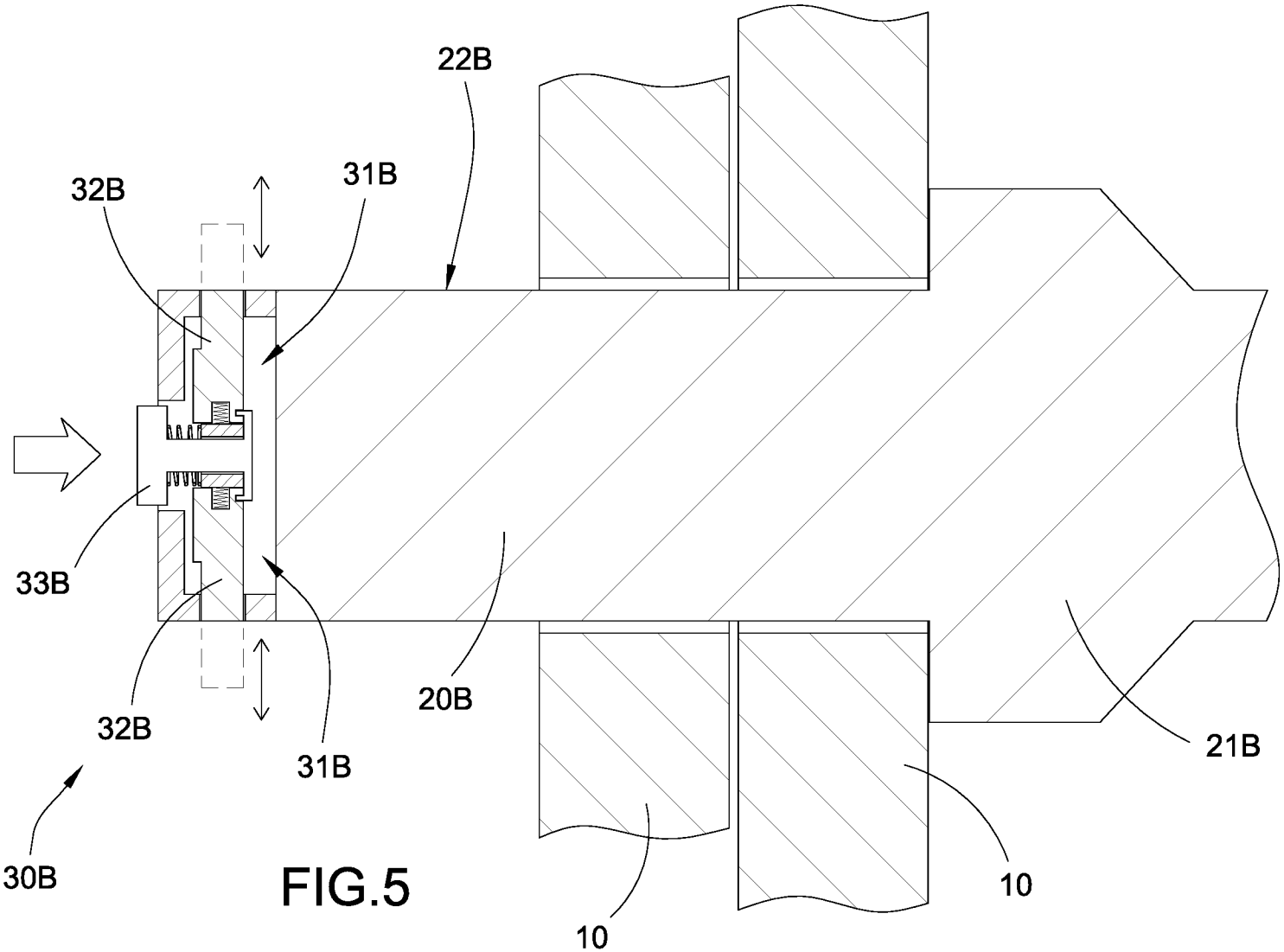
FIG. 5 is a sectional view of the exercise equipment according to the above second embodiment of the present invention.

As shown in FIGS. 4 and 5, a weight bar assembly of the exercise equipment according to a second embodiment illustrates an alternative mode of the first embodiment. The weight bar assembly comprises a weight bar 20B and a weight bar stopper 30B, wherein the weight plates 10 are slidably coupled at two end portions of the weight bar 20B from two free ends thereof respectively.

According to the second embodiment, the weight bar 20B comprises two stopping rims 21B spacedly and outwardly therefrom to define the weight bar 20B to have two end portions and the hand gripping portion. Each of the end portions of the weight bar 20B has a circular cross section defining a plurality of an outer circumferential surface 22B that the weight bar stopper 30B is formed at the outer circumferential surface 22B of the weight bar 20B.

The weight bar stopper 30B comprises at least two receiving cavities 31B oppositely indented on the outer circumferential surface 22B of the weight bar 20B, at least two stopper members 32B movably received within the receiving cavities 31B respectively to allow the weight plate 10 being slid in and out the end portion of the weight bar 20B, and a push actuator 33B operatively coupled at the free end of the weight bar 20B. When the push actuator 33B is pushed and actuated, the stopper members 32B are radially protruded out of the receiving cavities 31B respectively in a synchronized manner to block the weight plate 10 being slid at the end portion of the weight bar 20B.

As shown in FIG. 5, the receiving cavities 31B are located at two opposed sides of the weight bar 20B and are aligned with each other, wherein openings of the receiving cavities 31B face opposite with each other. Each of the stopper members 32B is slidably coupled at the weight bar 20B within the respective receiving cavity 31B, wherein each of the stopper members 32B is slidably moved in-and-out the respective receiving cavity 31B. Particularly, the stopper member 32B is radially extended to the outer circumferential surface 22B of the weight bar 20B. Preferably, the stopper member 32B are provided at each end portion of the weight bar 20 close to the free end thereof.

Each of the stopper members 32B has a blocking end 321B as the free end arranged in such a manner that when the stopper member 32B is moved in the receiving cavity 31B to hide the blocking end 321B therewithin, the weight plate 10 is adapted to slidably couple at the end portion of the weight bar 20B. When the stopper member 32B is moved out of the receiving cavity 31B to protrude the blocking end 321B thereof, the weight plate 10 is adapted to lock at the end portion of the weight bar 20B.

The weight bar stopper 30B further comprises a plurality of resilient members 33B supported in the receiving cavities 31B to bias against the stopper members 32B respectively so as to push the blocking end 321B of the stopper member 32B radially protruded from the outer circumferential surface 22B of the weigh bar 20B. As shown in FIG. 5, each of the resilient members 33B is a compression spring having an inner end coupled at the bottom wall of the receiving cavity 31B and an outer end coupled at the stopper member 32B to retain the stopper member 32B at the blocking position, such that the resilient member 32B is arranged to apply a resilient force for the stopper member 32B to upwardly push the stopper member 32B out of the receiving cavity 31B so as to retain the stopper member 32B at the stopping position. Accordingly, each of the stopper members 32B is actuated independently to downwardly push the stopper member 32B from the blocking position to the accessing position.

The push actuator 33B is provided at the free end of the weight bar 20B to unlock the stopper members 32 in a synchronized manner so as to release the stopper members 32B from the accessing position to the blocking position. In order to load the weight plate 10 at the weight bar 20B, the user is able to move the stopper members 32B from the blocking position to the accessing position by pressing the stopper members 32B in the receiving cavities 31B to hide the blocking ends 321B of the stopper members 32B within the receiving cavities 31B. The weight plate 10 can slide along the end portion of the weight bar 20B from the free end thereof at the loading direction. Once the weight plate 10 is loaded at the weight bar 30B, the push actuator 33B is pushed and actuated to release the stopper members 32B from the accessing position. The stopper members 32B are radially protruded out of the receiving cavities 31B respectively in a synchronized manner to block the weight plate 10 being slid at the end portion of the weight bar 20B.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An exercise equipment, comprising:

two or more weight plates each having a through slot;

a weight bar having two end portions each having an outer surface and a free end, wherein each of said two end portions is sized and shaped to fittingly and slidably penetrate through said through slots of said two or more weight plates to couple said two or more weight plates at said two end portions of said weight bar respectively; and two weight bar stoppers built-in at said two end portions of said weight bar respectively to increase a peripheral size of said weight bar at said two end portions to block said two or more weight plates being slid out of said two free ends of said two end portions of said weight bar, wherein when said two weight bar stoppers are actuated to adjust said peripheral size of said weight bar back to an original size thereof, said plurality of weight plates are allowed to be slid in and out said two end portions of said weight bar, wherein each of said weight bar stoppers has one or more receiving cavities spacedly provided on said weight bar and comprises one or more stopper members movably received in said one or more receiving cavities respectively, wherein when each of said one or more stopper members is received in said corresponding receiving cavity, each of said one or more stopper members is aligned with said outer surface of said corresponding end portion of said weigh bar to hide said stopper member, wherein when each said one or more stopper members is moved out of said corresponding receiving cavity, each of said one or more stopper members is radially moved out of said corresponding receiving cavity and protruded from said outer surface of said corresponding end portion of said weight bar to block said two or more weight plates being slid at said two end portions of said weight bar respectively, wherein each of said one or more stopper members coupled at said weight bar has a triangular shape defining a guiding surface and a blocking surface, such that when each of said one or more stopper members is received in said receiving cavity correspondingly, said guiding surface of said stopper member is aligned with said outer surface of said end portion of said weigh bar correspondingly to hide said blocking surface of said stopper member, and when said one or more stopper members are moved out of said one or more receiving cavities, said blocking surfaces of said one or more stopper members are protruded from said outer surface of said weight bar to block said plurality of weight plates being slid at said two end portions of said weight bar respectively.

2. The exercise equipment, as recited in claim 1, wherein each of said two weight bar stoppers further comprises a push actuator operatively coupled at said free end of said corresponding end portion of said weight bar, wherein when said push actuator is pushed and actuated, said one or more stopper members are radially protruded out in a synchronized manner to block said weight plate being slid at said corresponding end portion of said weight bar.

3. An exercise equipment, comprising:

two or more weight plates each having a through slot;

a weight bar having two end portions each having an outer surface and a free end, wherein each of said two end portions is sized and shaped to fittingly and slidably penetrate through said through slots of said two or more weight plates to couple said two or more weight plates at said two end portions of said weight bar respectively; and two weight bar stoppers built-in at said two end portions of said weight bar respectively to increase a peripheral size of said weight bar at said two end portions to block said two or more weight plates being slid out of said two free ends of said two end portions of said weight bar, wherein when said two weight bar stoppers are actuated to adjust said peripheral size of said weight bar back to an original size thereof, said plurality of weight plates are allowed to be slid in and out said two end portions of said weight bar, wherein each of said two weight bar stoppers comprises one or more stopper members and a push actuator operatively coupled at said free end of said corresponding end portion of said weight bar, wherein when said push actuator is pushed and actuated, said one or more stopper members are radially protruded out in a synchronized manner to block said weight plate being slid at said corresponding end portion of said weight bar, wherein each of said one or more stopper members coupled at said weight bar has a triangular shape defining a guiding surface and a blocking surface, such that when each of said one or more stopper members is received in said receiving cavity correspondingly, said guiding surface of said stopper member is aligned with said outer surface of said end portion of said weigh bar correspondingly to hide said blocking surface of said stopper member, and when said one or more stopper members are moved out of said one or more receiving cavities, said blocking surfaces of said one or more stopper members are protruded from said outer surface of said weight bar to block said plurality of weight plates being slid at said two end portions of said weight bar respectively.

4. An exercise equipment, comprising:

two or more weight plates each having a through slot;

a weight bar having two end portions each having an outer surface and a free end, wherein each of said two end portions is sized and shaped to fittingly and slidably penetrate through said through slots of said two or more weight plates to couple said two or more weight plates at said two end portions of said weight bar respectively; and two weight bar stoppers built-in at said two end portions of said weight bar respectively to increase a peripheral size of said weight bar at said two end portions to block said two or more weight plates being slid out of said two free ends of said two end portions of said weight bar, wherein when said two weight bar stoppers are actuated to adjust said peripheral size of said weight bar back to an original size thereof, said plurality of weight plates are allowed to be slid in and out said two end portions of said weight bar, wherein said weight bar further comprises two stopping rims spacedly and outwardly therefrom to define said weight bar into a mid-portion as a hand gripping portion and two outer portions as said two end portions, wherein a diameter of each of said stopping rims is larger than a diameter of said through slot of each of said two or more weight plates, such that when each of said two or more weight plates is slid from said free end along said end portion of said weight bar, said weight plate is blocked by said stopping rim to prevent said weight plate being slid to said mid-portion of said weight bar, wherein said two weight bar stoppers are pivotally coupled at said two end portions of said weight bar respectively, wherein each of said two weight bar stoppers is actuated between an accessing position and stopping position, such that at said accessing position, said weight bar stopper is aligned along an axis of said weight bar to allow said weight plate being slid at said end portion thereof, and at said stopping position, said two weight bar stoppers are radially protruded out of said weight bar to block said two or more weight plates being slid out of said free ends of said two end portions of said weight bar respectively.

5. An exercise equipment, comprising:

two or more weight plates each having a through slot;

a weight bar having two end portions each having an outer surface and a free end, wherein each of said two end portions is sized and shaped to fittingly and slidably penetrate through said through slots of said two or more weight plates to couple said two or more weight plates at said two end portions of said weight bar respectively; and two weight bar stoppers built-in at said two end portions of said weight bar respectively to increase a peripheral size of said weight bar at said two end portions to block said two or more weight plates being slid out of said two free ends of said two end portions of said weight bar, wherein when said two weight bar stoppers are actuated to adjust said peripheral size of said weight bar back to an original size thereof, said plurality of weight plates are allowed to be slid in and out said two end portions of said weight bar, wherein each of said two end portions of said weight bar has a non-circular cross section defining a flat outer surface, wherein said two weight bar stoppers are formed at said flat outer surfaces of said two end portions of said weight bar, wherein said two weight bar stoppers are pivotally coupled at said two end portions of said weight bar respectively, wherein each of said two weight bar stoppers is actuated between an accessing position and a stopping position, such that at said accessing position, said weight bar stopper is aligned along an axis of said weight bar to allow said weight plate being slid at said end portion thereof, and at said stopping position, said two weight bar stoppers are radially protruded out of said weight bar to block said two or more weight plates being slid out of said free ends of said two end portions of said weight bar respectively.

6. An exercise equipment, comprising:

two or more weight plates each having a through slot;

a weight bar having two end portions each having an outer surface and a free end, wherein each of said two end portions is sized and shaped to fittingly and slidably penetrate through said through slots of said two or more weight plates to couple said two or more weight plates at said two end portions of said weight bar respectively; and two weight bar stoppers built-in at said two end portions of said weight bar respectively to increase a peripheral size of said weight bar at said two end portions to block said two or more weight plates being slid out of said two free ends of said two end portions of said weight bar, wherein when said two weight bar stoppers are actuated to adjust said peripheral size of said weight bar back to an original size thereof, said plurality of weight plates are allowed to be slid in and out said two end portions of said weight bar, wherein each of said two end portions of said weight bar has a circular cross section defining a plurality of outer circumferential surfaces, wherein said two weight bar stoppers are formed at said two outer circumferential surfaces of said two end portions of said weight bar respectively, wherein said two weight bar stoppers are pivotally coupled at said two end portions of said weight bar respectively, wherein each of said two weight bar stoppers is actuated between an accessing position and a stopping position, such that at said accessing position, said weight bar stopper is aligned along an axis of said weight bar to allow said weight plate being slid at said end portion thereof, and at said stopping position, said two weight bar stoppers are radially protruded out of said weight bar to block said two or more weight plates being slid out of said free ends of said two end portions of said weight bar respectively.

* * * * *